US005450649A

United States Patent [19]

Turnbull

[11] Patent Number: 5,450,649

[45] Date of Patent: Sep. 19, 1995

[54] COLLECTION DEVICES

[75] Inventor: Kenneth J. Turnbull, Corbridge, England

[73] Assignee: Electrolux Outdoor Products Limited, Newton Aycliffe, England

[21] Appl. No.: 80,286

[22] Filed: Jun. 21, 1993

[30] Foreign Application Priority Data

Sep. 11, 1992 [GB] United Kingdom ..... 9219330

[51] Int. Cl.[6] ..... A47L 5/18

[52] U.S. Cl. ..... 15/330; 15/345; 15/409

[58] Field of Search ..... 15/405, 409, 345, 346, 15/330

[56] References Cited

U.S. PATENT DOCUMENTS

| | | | |
|---|---|---|---|
| 751,786 | 2/1904 | Elston | 15/409 |
| 2,902,708 | 9/1959 | Riley | 15/409 X |
| 4,018,483 | 4/1977 | Smith | 15/409 X |
| 5,280,667 | 1/1994 | Coathupe | 15/409 |

FOREIGN PATENT DOCUMENTS 2138280 10/1984 United Kingdom .

*Primary Examiner*—Christopher K. Moore
*Attorney, Agent, or Firm*—Pearne, Gordon, McCoy & Granger

[57] ABSTRACT

A collection device having a duct for transporting material entrained in a stream of pressurized primary air from a collection mouth at an upstream end of the duct to a downstream region of the duct for collection. The device provides at least one primary air inlet opening into the duct for delivering pressurized air to form a primary air stream directed generally downstream of the duct and at least one secondary air outlet for delivering pressurized air to form a secondary air stream directed onto an area of the surface confronting the collection mouth. The secondary air stream serves to dislodge material on the confronting area for entrainment in the primary air stream and transportation from the collection mouth to the downstream region of the duct for collection.

10 Claims, 2 Drawing Sheets

COLLECTION DEVICES

BACKGROUND OF THE INVENTION

This invention relates to an apparatus for collecting material from a surface. Various forms of collection apparatus have been proposed for collecting material under suction—so called vacuum cleaners for domestic use—as well as suction cleaners for collecting material and refuse from streets, gardens etc.

SUMMARY OF THE INVENTION

It is an object of the present invention to produce a collection device operable upon a suction principal and including one or more jets of pressure air for dislodging material from a surface to assist in the collection thereof.

According to the present invention, an apparatus for collecting material from a surface comprises a duct for transporting material entrained in a stream of pressurized air from a collection mouth at an upstream end of the duct to a downstream region of the duct for collection, the collection mouth being located above a surface, at least one primary air inlet opening into the duct for delivering pressurized air to form a primary air stream directed generally downstream of the duct, which induces a stream of ambient air from around the collection mouth into the duct via the collection mouth, at least one secondary air outlet for delivering pressurized air to form a secondary air stream directed generally away from the collection mouth and onto an area of the surface confronting the collection mouth, the secondary air stream serving to dislodge material on the said confronting area for entrainment in the primary air stream and transportation from the collection mouth to the downstream region of the duct for collection.

Preferably, the at least one secondary air outlet is shaped to direct pressure air away from the apparatus and at an obtuse angle relative to the stream of primary air flowing downstream within the duct.

The at least one secondary air outlet may directed secondary air at an acute angle relative to the confronting area of the said surface to dislodged material on the said area.

BRIEF DESCRIPTION OF THE DRAWINGS

One form of apparatus according to the present invention will now be described by way of example with reference to the accompanying drawings in which.

DETAILED DESCRIPTION OF THE PREFERRED EMBODIMENTS

Figure 1:
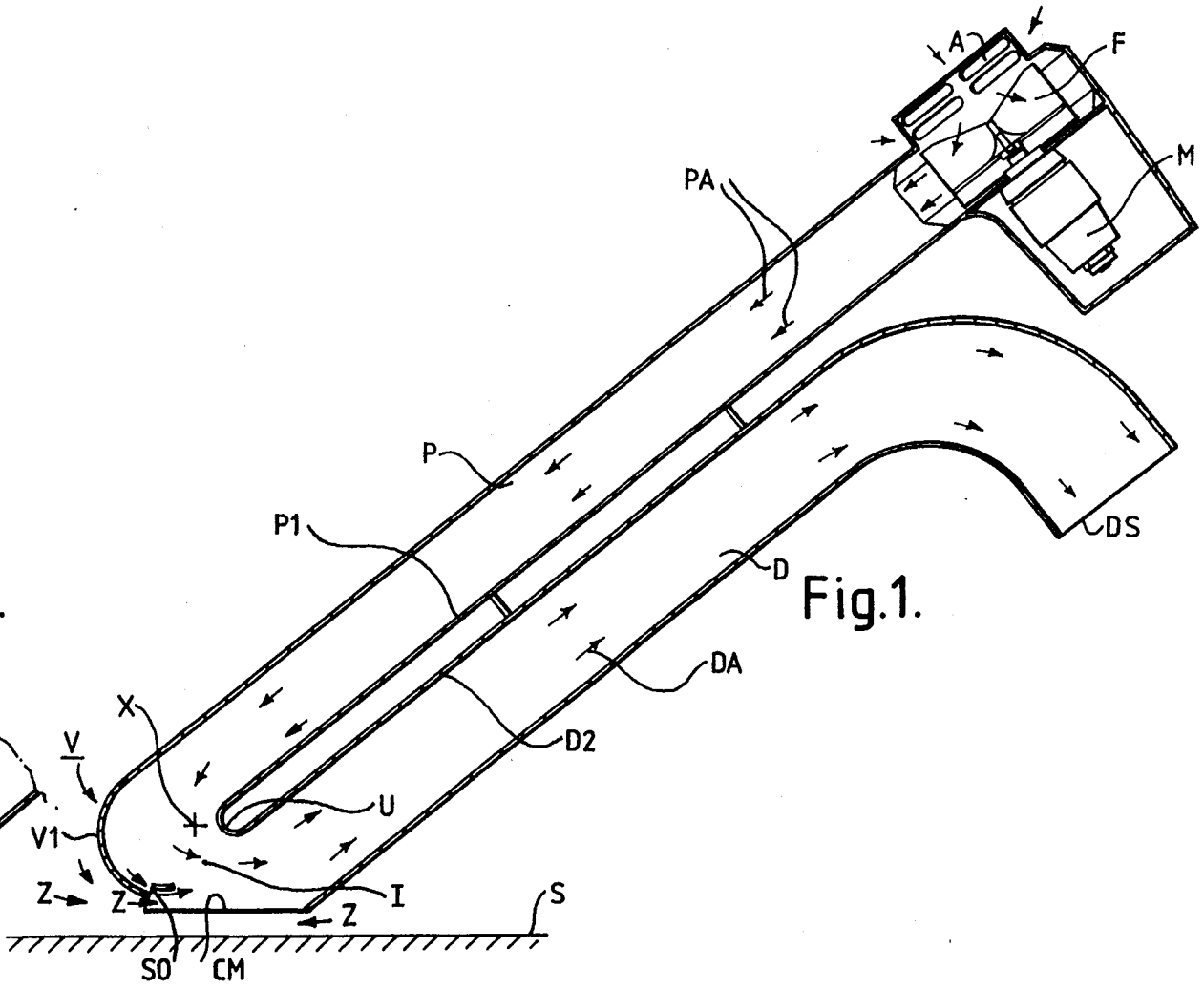
FIG. 1 is a longitudinal cross-section of a first form of apparatus with a control valve in a first position for using the apparatus in a suction mode.

FIG. 1 shows the apparatus in an "in use" position relative to a surface S from which material is to be collected. The apparatus has a duct D, a plenum chamber P and a fan F driven by an electric motor M for creating a source of pressure air. Air is drawn into the apparatus through apertures A and air under pressure is directed into the plenum chamber P as indicated by arrows PA. Air passes under pressure from the plenum chamber P into the duct D through a primary inlet I located at the upstream end of the duct D to create a primary stream of air which flows downstream in the direction of arrows DA.

In order to assist the flow of pressure air from the plenum chamber P into the duct D via the inlet I, walls P1 and D2 of the plenum chamber and the duct are interconnected by a smooth U-shaped wall U. A collection container (not shown) is connectable to downstream end DS of the duct D. The duct D has a collection mouth CM disposed in a plane inclined as indicated in FIG. 1 relative to the longitudinal extent of the duct D.

Figure 2:
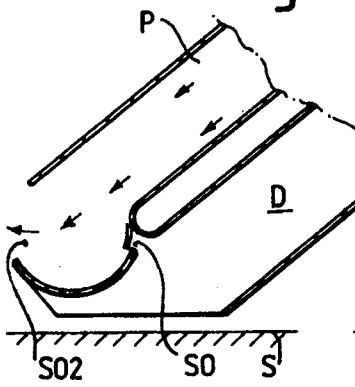
FIG. 2 is a longitudinal section of a part of FIG. 1 with the control valve in a second position for using the apparatus in a blow mode.

A control valve V having a wall V1 in the form of a segment of a cylinder is angularly movable about an axis X between a position shown in FIG. 1 in which the inlet I is fully open to allow the primary stream of air to pass from the plenum chamber P into the duct D and a position shown in FIG. 2 in which the inlet I is closed except for the secondary outlet S0. In the position shown in FIG. 2 pressure air exits from the plenum chamber P through an additional secondary inlet S02.

The secondary outlet SO is in the form of a narrow slot and in the position shown in FIG. 1 is disposed adjacent to the collection mouth CM. The secondary outlet SO directs a relatively narrow and concentrated jet of air across the collection mouth CM and downwardly towards the surface S.

In operation, and with the valve V in the position shown in FIG. 1, the primary stream of pressurized air flowing through the duct D produces a negative pressure in the region of the collection mouth and the surface S inducing a flow of ambient air indicated, by arrows Z thereby drawing material to be collected from the surface S. Material from the surface S is thus entrained in the primary air stream, transported downstream in the duct D and into a collection container. The concentrated jet of air from the secondary outlet SO impinges on the surface S at an acute angle and serves to dislodge material on the surface prior to being picked up and entrained in the primary air stream.

When the valve V is moved into the position shown in FIG. 2, the inlet I is effectively closed and pressure air exits through the additional secondary outlet S02. In this condition, the apparatus may be used to blow material to be collected from the surface S into a pile and, in order to collect the pile of material, the valve V is simply changed into the position shown in FIG. 1.

The valve V may be operated, electrically or manually in a manner known to those skilled in the art.

Figure 3:
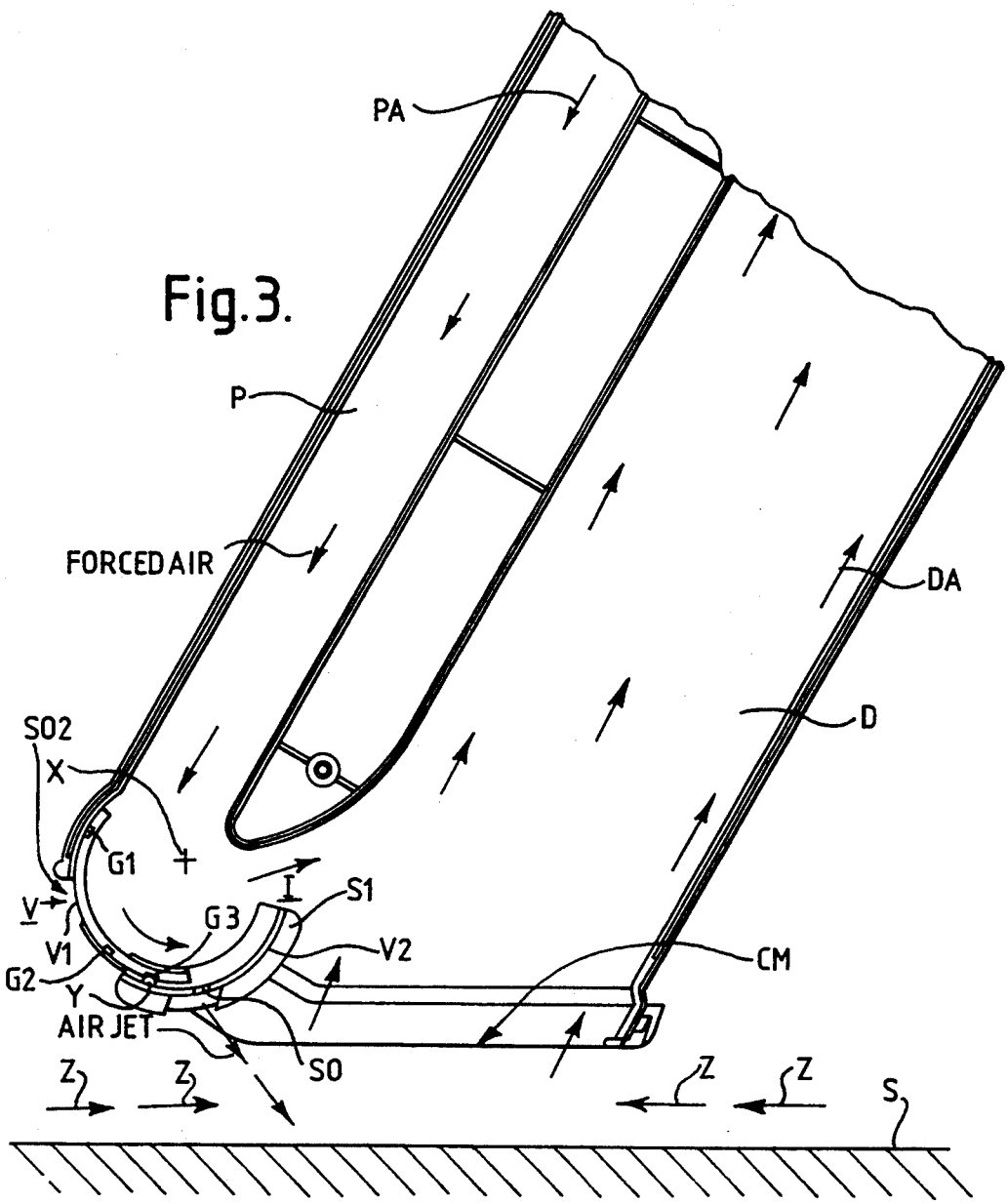
FIG. 3 is a longitudinal section, similar to FIG. 2 showing a second form of apparatus.

Referring to FIG. 3 in which like components are designated with the same reference numbers used in FIGS. 1 and 2, the second form of apparatus is illustrated including a modified secondary outlet and control valve arrangement.

A curved wall V2 in the form of a segment of a regular cylinder is located between two supports S1 (of which only one is shown) carried on opposite side walls of the plenum chamber. A further curved wall V1 corresponding to the wall V1 of the valve shown in FIGS. 1 and 2 also in the form of a segment of a regular cylinder is mounted for angular movement about its axis of symmetry X. The wall V1 has three grooves G1, G2 G3 and angular movement thereof can be constrained in three separate positions when the respective grooves G1, G2, G3 are in engagement with a projection Y on the wall V2. It will be appreciated, that in a similar manner to operation of the apparatus of FIGS. 1 and 2 angular movement of the wall V2 serves to 1) open inlet I, open secondary outlet SO and close additional secondary outlet S02. See FIG. 3 when projection Y in engagement with groove G3.
2) open inlet I and close both outlets SO and SO2 when the projection Y is engaged with groove G2, and
3) close inlet I, close outlet SO and open outlet SO2 when projection Y is in engagement with groove G1.

In operation with inlet I and secondary outlet SO both open and outlet SO2 closed, the primary air stream flowing in the duct D produces a negative pressure in the region of the collection mouth CM creating an induced flow of ambient air indicated by arrows Z. Material on the surface S is lifted from the surface S by the flow of pressurized air entrained therein and transported downstream of the duct D for collection. A secondary stream of air issuing from the secondary outlet SO is, (as shown in FIG. 3) directed at an acute angle to the surface S and serves to dislodge material on the surface and thereby assist pick-up, entrainment and subsequent transportation of the material for collection.

Although reference has been made to the use of a single source of pressure air, if desired, separate sources of pressure air may be used for the primary and secondary air flows. Further, to assist dislodging material which has a tendency to adhere to the surface S, a pulsating secondary air stream may be used. Pulsating of the secondary air stream may be produced by a rotatable paddle wheel not shown mounted in the region of the outlet SO.

Alternatively, pulsation may be caused by mounting a thin plate in slots affording freedom of movement to the plate and formed in the sidewalls of the apparatus. The plate is disposed longitudinally of the outlet SO and is displaced outwardly therefrom in the direction of flow of the secondary stream of pressurized air. The freedom of movement of the plate in the slots affords considerable clearance to the thin plate permitting a pulsating movement in the direction of flow of the secondary air stream.

We claim:

1. Apparatus for collecting material from a surface, the apparatus comprising a duct for transporting material entrained in a stream of pressurized primary air from a collection mouth at an upstream end of the duct to a downstream region of the duct for collection, at least one primary air inlet opening into the duct for delivering pressurized air from said at least one inlet to form a primary air stream directed generally downstream of the duct, at least one secondary air outlet for delivering pressurized air from said at least one outlet to form a secondary air stream directed onto an area of the surface confronting the collection mouth, the secondary air stream serving to dislodge material on the said confronting area for entrainment in the primary air stream and transportation from the collection mouth to the downstream region of the duct for collection, at least one additional secondary air outlet disposed to direct a stream of secondary air externally of the apparatus and at a position displaced from the collection mouth, and a control valve for selectively controlling flow of primary and secondary air to the primary air inlet, the secondary air outlet and the additional secondary air outlet, the flow of primary and secondary air to the primary air inlet and the secondary air outlet being disabled when the control valve selects the additional secondary air outlet.

2. Apparatus according to claim 1 wherein said at least one secondary air outlet is shaped to direct pressure air away from the apparatus and at an obtuse angle relative to the stream of primary air flowing downstream within the duct.

3. Apparatus according to claim 1 wherein said at least one secondary air outlet directs secondary air at an acute angle relative to the confronting area of the said surface to dislodged material on the said area.

4. Apparatus according to claim 1 wherein said at least one secondary air outlet is disposed in the region of the collection mouth.

5. Apparatus according to claim 1 wherein said at least one secondary outlet is disposed in a peripheral region of the collection mouth.

6. Apparatus according to claim 5 wherein said at least one secondary outlet directs pressurized secondary air away from the collection mouth and at an acute angle relative to the area of the surface confronting the collection mouth.

7. Apparatus according to claim 1 wherein the control valve is additionally movable into a position in which said at least one additional secondary air outlet is closed when said at least one primary air inlet is open.

8. Apparatus according to claim 1 wherein the control valve comprises a segment of a cylinder having an axis of curvature, the segment mounted for angular displacement about said axis of curvature and movable between positions in which selected air outlets are open or closed.

9. Apparatus according to claim 1 or claim 8 including means for producing a source of pressurized air and means for directing pressurized air to the air inlets and the air outlets.

10. Apparatus according to claim 1 wherein the means for directing pressurized air from the said source to the primary air inlet(s) and the secondary air outlet(s) is a plenum chamber.

* * * * *

UNITED STATES PATENT AND TRADEMARK OFFICE

CERTIFICATE OF CORRECTION

PATENT NO. : 5,450,649

DATED : September 19, 1995

INVENTOR(S) : Turnbull, et. al.

It is certified that error appears in the above-indentified patent and that said Letters Patent is hereby corrected as shown below:

Inventors:

Title page, item [19] should read -- Turnbull, et. al.--.

item [75] should read -- Kenneth J. Turnbull, Corbridge; John S. Davies, Darlington; both of England--.

Signed and Sealed this

Seventh Day of May, 1996

*Attest:*

*Attesting Officer*

BRUCE LEHMAN

*Commissioner of Patents and Trademarks*